US008691745B2

(12) United States Patent
Batchelor et al.

(10) Patent No.: US 8,691,745 B2
(45) Date of Patent: Apr. 8, 2014

(54) FABRIC CONDITIONERS CONTAINING BLEACH AND OLEFINIC PRO-FRAGRANCE

(75) Inventors: Stephen Norman Batchelor, Wirral (GB); Mansur Sultan Mohammadi, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 418 days.

(21) Appl. No.: 12/676,181

(22) PCT Filed: Aug. 22, 2008

(86) PCT No.: PCT/EP2008/061038

§ 371 (c)(1), (2), (4) Date: Mar. 30, 2010

(87) PCT Pub. No.: WO2009/030600

PCT Pub. Date: Mar. 12, 2009

(65) Prior Publication Data

US 2010/0216679 A1 Aug. 26, 2010

(30) Foreign Application Priority Data

Sep. 8, 2007 (GB) ..... 0717485.7

(51) Int. Cl.
*C11D 3/60* (2006.01)

(52) U.S. Cl.
USPC ..... 510/518

(58) Field of Classification Search
USPC ..... 510/518
See application file for complete search history.

(56) References Cited

U.S. PATENT DOCUMENTS

| | | | | |
|---|---|---|---|---|
| 4,255,273 | A * | 3/1981 | Sakkab | 8/103 |
| 5,916,481 | A | 6/1999 | Willey | |
| 6,277,796 | B1 | 8/2001 | Sivik et al. | |
| 6,410,501 | B1 | 6/2002 | Jones et al. | |
| 6,410,510 | B1 | 6/2002 | Panayotatos et al. | |
| 6,511,948 | B1 | 1/2003 | Bettiol et al. | |
| 6,583,105 | B1 | 6/2003 | Hohener et al. | |
| 2003/0228992 | A1 * | 12/2003 | Smets et al. | 510/267 |
| 2004/0048764 | A1 | 3/2004 | Kim et al. | |
| 2005/0153869 | A1 | 7/2005 | Connor et al. | |
| 2005/0192634 | A1 | 9/2005 | Beaudoin | |

FOREIGN PATENT DOCUMENTS

| | | | |
|---|---|---|---|
| EP | 971025 | * | 1/2000 |
| WO | WO9816538 | | 4/1998 |
| WO | 98/32627 | | 7/1998 |
| WO | 99/20722 | | 4/1999 |
| WO | 01/44424 | A1 | 6/2001 |
| WO | 03/018451 | A1 | 2/2003 |
| WO | 2005/037973 | A1 | 4/2005 |
| WO | 2006/003237 | A2 | 1/2006 |
| WO | WO 2006005480 | * | 1/2006 |
| WO | WO2006032327 | | 3/2006 |
| WO | WO2006058297 | | 6/2006 |
| WO | WO2006066705 | | 6/2006 |
| WO | WO2008020058 | | 2/2008 |
| WO | WO2008026140 | | 3/2008 |
| WO | WO2008020058 | | 11/2008 |

OTHER PUBLICATIONS

International Search Report, PCT/EP2008/061038, mailed Dec. 8, 2008, 3 pp.
GB Search Report, GB0717485.7, dated Apr. 17, 2008, 1p.
Belitz H-D Grosch W: "Food chemistry" 1999, Springerverlag, XP002503882, p. 184-p. 199.
Co-pending Application: Applicant: Hunter et al., U.S. Appl. No. 12/676,147, filed Mar. 30, 2010.
Gunstone, "Chemical Properties, Autoxidation and photo-oxygenation", Lipid Handbook, Second Edition, Dec. 31, 1994, p. 566-571, Second Edition.
Padley et. al., "Occurrence and characteristics of oils and fats, Animal fats: milk and depot fats (FBP)", Lipid Handbook, Second Edition, Dec. 1994, p. 156-165, Second Edition.
Young et al., "Processing of fats and oils, Paints and Varnishes", Lipid Handbook, Second Edition, Dec. 31, 1994, p. 316.

* cited by examiner

*Primary Examiner* — John Hardee
(74) *Attorney, Agent, or Firm* — Greenberg Traurig, LLP

(57) ABSTRACT

A fabric conditioner composition comprising a) a photobleach; b) a quaternary ammonium fabric conditioner; and c) an olefinic pro-fragrance.

13 Claims, No Drawings

FABRIC CONDITIONERS CONTAINING BLEACH AND OLEFINIC PRO-FRAGRANCE

TECHNICAL FIELD

The present invention concerns improvements relating to fabric conditioners and particularly to the in-situ generation of perfume components in fabric conditioning compositions.

BACKGROUND OF THE INVENTION

WO 2002/038120 (P&G) relates to photo-labile pro-fragrance conjugates which upon exposure to electromagnetic radiation are capable of releasing a fragrant species.

Many bleach components of laundry and other cleaning compositions are known to interact with perfume components as a consequence it has been suggested to either select bleach components and perfumes which do not react or to physically separate perfume components from bleach components in many products. It has therefore been suggested that perfume components for use in formulations with those catalysts which make use, either directly or indirectly of atmospheric oxygen should be selected so as to minimise interaction between the perfume components and the bleach catalyst. In laundry tablets for example, any bleaching agents present and any perfume components can be placed in different layers of the tablets.

While bleach components are often present in laundry cleaning compositions they are not typically present in conditioning compositions. For example WO98/32827 (P&G) relate to laundry main wash compositions containing photo-bleach. Examples 21-24 contain alkyl di-methyl ammonium chloride at max 1% and a significantly larger (at least 15%) level of LAS. Thus, while a cationic component is present in the formulation this is a detergent composition and not a rinse conditioning agent. Similarly, US 2005/0153869 (P&G) discloses a laundry detergent composition which comprises "AQA" (a quaternary ammonium surfactant) in combination with mid-branched fatty soaps at levels which would make the composition a detergent. A photo-bleach can be present at up to 0.1% and perfume appears to be an optional ingredient.

Brazilian Patent Application PI 9806684-6 discloses a softening composition for fabrics which contains anionic optical brighteners and may also contain photo-bleach.

WO 01/44424 (Unilever) discloses a fabric care composition which contains a radical initiator (to assist in cleaning). Example 5 discloses a rinse conditioner based on 1,2 bis-[hardened tallowoyloxy]-3-thrimethylammoniumpropane chloride (generally known as "HEQ") which also contains perfume (unspecified) and Irgacure 819 (a radical initiator).

BRIEF DESCRIPTION OF THE INVENTION

We have now determined that a broad class of pro-fragrances can usefully be converted to volatile odoriferous species by photo-bleaches. Quite unexpectedly, when this is done in a fabric conditioning composition which comprises perfume, there is a surprising improvement in the longevity of the perfume.

According to the present invention there is provided a fabric conditioner composition comprising:

a) a photo-bleach, b) a quaternary ammonium fabric conditioner, other than 1,2 bis[hardened tallowoyloxy]-3-thrimethylammoniumpropane chloride, and, c) at least one of perfume or pro-fragrance In the context of the present invention a "photo-bleach" is any chemical species (preferably other than a pro-fragrance) which forms a reactive bleaching species on exposure to sunlight, and preferably is not permanently consumed in the reaction. Preferred photo-bleaches include singlet oxygen photo-bleaches and radical photo-bleaches. Suitable photo-bleaches are described in more detail below.

In the context of the present invention a pro-fragrance is any chemical species (preferably other than a photo-bleach), which is a precursor of a volatile odoriferous compound and may be converted into the volatile odoriferous compound (or a further precursor thereof) by the presence of an active photo-bleach.

Preferred pro-fragrances contain at least one, non-aromatic, C=C double-bond, more preferably at least two C=C double-bonds.

Preferably, the pro-fragrance is a lipid.

In a preferred case, the pro-fragrance is one which upon exposure to the photo-bleach is converted into one or more volatile odoriferous components with a lower olfactive perception threshold than the pro-fragrance: i.e. it can be detected by the human nose at a lower level that the lipid at a temperature of 20° C.

Preferred pro-fragrances comprise mono- or di-unsaturated fatty acids (or their salts). Surprisingly, oxidation of these lipids by photo-bleach appears to reduce the production of the rancid, oily "off" odour which is often associated with oxidation of oils and fats. For example, oleic acid oxidises to produce nonanal (described as fruity), decanal (waxy orange) and 2tr-decenal (orange peel). Linoleic acid produces hexanal (powerful fruity, green), heptanal (powerful, fruity vinous), octenal (orange) and 2c-octenal (walnut). Linolenic acid produces 2tr-pentenal (apple) and 3c-hexenal (green, leafy).

It is believed that the compounds initially formed during the low temperature oxidation of lipids differ (either in kind or level) from those produced at higher temperatures or from prolonged oxidation. For example, hexanal (powerful fruity, green) dominates the volatile composition in low temperature oxidation of linoleates, whereas at higher temperatures 2,4-decadienal dominates.

Plant oils contain small level of sterols (for example peanut oil contains 6.2 mg/kg of cholesterol but the major component is beta-sistestrol ~1.145 g/kg in peanut, 1.317 g/kg in soya), carotenoids which play an important antioxidant role in fat and oils, some tocopherol (wheat germ oil has the largest level 133 mg/kg) and vitamins. It is believed that these lipids can also be usefully oxidised to aroma chemicals.

The oxidative degradation of carotenoids gives aroma compounds. For example alpha-carotene generates alpha-ionone a known aroma component found in raspberry, beta-carotene generates beta-ionone found in raspberry, passion fruit and black tea, and neoxanthin generates beta-damascenone found in coffee, beer, honey, wine and apple.

Preferred levels of photo-bleach present in the composition are from 0.00001 to 0.05 wt % preferably 0.00005 to 0.01%.

Generally, a far lower level of photo-bleach is used than would be used in practice where the objective of the photo-bleach was simply stain removal. Preferred levels of pro-fragrance present in the composition are from 0.01 to 5 wt % preferably from 0.05 to 4.0 wt %. All percentages used anywhere in this specification being in wt % unless otherwise stated.

Headspace analysis of cotton cloth which has been laundered and dried indoors as opposed to cloth dried outdoors in sunlight shows that many natural odours, (particularly aldehydes, which can be obtained by the reaction of photo-bleaches with plant oils) can be recovered at low levels from the outdoor sun-dried cloth but not from the indoor dried cloth. It is believed that this may be due to the natural action of sunlight on plant lipids naturally present in cotton. Ensuring that these aldehydes are produced, or increasing the level of their production, provides a strong olfactive cue to users. Thus, the present invention provided similar lipids via the conditioner and assists their conversion into odour molecules by providing a photo-bleach.

Some photo-bleaches impart colour to the fabric. To maintain an appealing white hue, it is preferred if blue or violet shading dyes are used in combination with the photo-bleaches. In the alternative, a combination of photo-bleaches may be used to generate a white hue, i.e. at least one of the photo-bleaches may also function as a shading dye. Preferred overall hue angles are 250 and 320, preferably 270 to 300.

Shading dyes are known in the art to counteract negative colour impressions and are described in further detail below. Preferred dyes are as described in WO2005/003274 (Unilever) and WO2005/003277 (Unilever). Particularly preferred shading dyes are bis azo direct dyes, particularly those of the direct violet 9, 35 and 99 type and acid azine dyes such as acid violet 50 and acid blue 98. Alternative shading dyes are described below.

As noted above, the shading dye and the photo-bleach can be the same chemical species. Examples of photo-bleaches which are also suitable as shading dyes include xanthene and metal phthalocyanine salts including those available in the marketplace as TINOLUX™ ex CIBA.

It is particularly preferred that the compositions of the invention are free of fluorescer.

The present invention also provides a method of conditioning fabrics which comprises the step of treating the fabrics with a composition according to the present invention.

It is believed that the presence of a photo-bleach also seems to help avoid a "musty" smell which can arise on drying and provide either a neutral or a desirable fresh and clean smell.

The present invention also extends to the use of a photo-bleach to improve the longevity of fragrance of a laundry conditioning product.

The present invention also extends to the use of a photo-bleach to convert a pro-fragrance into a perfume component during either use or storage of a laundry conditioning product.

DETAILED DESCRIPTION OF THE INVENTION

In order that the present invention may be further understood it is described below with reference to various preferred features.

Photo-Bleaches

As noted above the photo-bleaches suitable for use in the present invention include singlet oxygen photo-bleaches and radical photo-bleaches. Singlet oxygen photo-bleaches are preferred as these are believed to be less likely to engage in side-reactions leading to the formation of less pleasant odours.

Singlet Oxygen Photo-Bleaches:

Singlet oxygen photo-bleaches (PB) function as follows:

$$PB + \text{light} \rightarrow PB^*$$

$$PB^* + {}^3O_2 \rightarrow PB + {}^1O_2$$

The photo-bleach molecule absorbs light and attains an electronical excited state, PB*. This electronically excited state is quenched by triplet oxygen, $^3O_2$, in the surroundings to form singlet $^1O_2$. Singlet oxygen is a highly reactive bleach.

Suitable singlet oxygen photo-bleaches may be selected from, water soluble phthalocyanine compounds, particularly metallated phthalocyanine compounds where the metal is Zn— or Al—Z1 or mixture of Zn— and Al—Z1 where Z1 is a halide, sulphate, nitrate, carboxylate, alkanolate or hydroxyl ion. Preferably the phthalocyanin has 1-4 $SO_3X$ groups covalently bonded to it where X is an alkali metal or ammonium ion. Such compounds are described in WO2005/014769 (Ciba).

Xanthene type photo-bleaches are also preferred, particularly based on the structure:

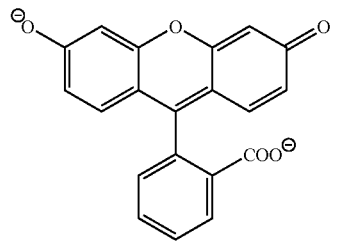

where the dye may be substituted by halogens and other elements/groups. Particularly preferred examples are Food Red 14 (Acid Red 51), Rose Bengal, Phloxin B and Eosin Y.

Quantum yields for photosensitized formation of singlet oxygen may be found in J. Phys. Chem. Ref. Data 1993, vol 22, nol pp 113-262. It is preferred if the quantum yield for singlet oxygen formation measured in $D_2O$ is greater than 0.05, more preferably greater than 0.1.

Other singlet oxygen producing compounds include chlorophyll, porphyrins, myoglobin, riboflavin, bilirubin, and methylene blue.

The singlet oxygen photo-bleaches generally impart some colour to the fabric. To give the clothes an appealing white hue, it is preferred if blue or violet shading dyes are used. As noted above, preferred overall hue angles are between 250 and 320, preferably 270 to 300 for the combination of the photo-bleach and the shading dye on the cloth.

Preferably the photo-bleaches are used in combination with the shading dyes as described in WO2005/003274 (Unilever) and WO2005/003277 (Unilever). Particularly preferred shading dyes are bis azo direct dyes of the direct violet 9, 35 and 99 type and acid azine dyes such as acid violet 50 and acid blue 98.

As noted above, single or combinations of photo-bleach can be employed to give an appropriate hue. Particularly advantageous results are obtained by use of the combination of a xanthene and a phthalocyanine photo-bleach. In particular, excellent results are obtained with a combination of an acid red xanthene photo-bleach and a green-blue sulphonated Zn/Al phthalocyanine photo-bleach.

Radical Photo-Bleaches:

Radical photo-bleaches (radical photo-initiators) are well known chemicals in the plastics and curing industry. These applications have been widely discussed in the literature see e.g. H. F. Gruber Prog. Polym. Sci. 17 (1992), 953-1044 and references therein. They are organic chemicals which on exposure to light react to form neutral radicals that may initiate the polymerization of alkenes. Recently they have been found to be effective laundry bleaches: UK patent application 9917451.8 teaches their use from main wash detergent powders and liquids, where the photo-initiators are intimately mixed into the powder or liquids.

Radical photo-bleaches are molecules that absorb light (typically 290-400 nm) to produce organic carbon-centred radicals.

Radical photo-bleaches may function by intermolecular hydrogen abstraction or by intra-molecular alpha or beta bond cleavage. Bond cleavage photo-bleaches are preferred to hydrogen abstraction photo-bleaches.

Suitable radical photo-bleaches may be selected from quinones, ketones, aldehydes, and phosphine oxides. Preferably the maximum extinction coefficient is between 290 and 400 nm (measured in ethanol) is greater than 10, more preferably greater than 100 mol-1 L cm-1.

A particularly preferred class of radical photo-bleaches are based on the structure:

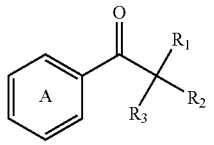

Where

R1 may be H, OH, Oalkyl preferably methoxy or ethoxy

R2 may be H, C1-C9 alkyl branched or linear

R3 may be H, C1-C9 alkyl

Preferably R1, R2 and R3 are hydrogen

The phenyl ring, A, may be substitute at the 3, 4 and 5 position by:

C1-C9 allyl branched of linear, preferably methyl, ethyl, OR4 where R4 may be C1-C9 alkyl branched of linear, preferably methyl, ethyl, Preferred examples of this type are 4 methyl acetophenone, 4 methoxy acetophenone. Vitamin K3 are also a preferred radical photo-bleach.

Other suitable bond cleavage radical photo initiators may be selected from the following groups:

(a) alpha amino ketones, particularly those containing a benzoyl moiety, otherwise called alpha-amino acetophenones, for example 2-methyl 1-[4-phenyl]-2-morpholinopropan-1-one (Irgacure 907, trade mark), (2-benzyl-2-dimethyl amino-1-(4-morpholinophenyl)-butan-1-one (Irgacure 369, trade mark);

(b) alphahydroxy ketones, particularly alpha-hydroxy acetophenones, eg (1-[4-(2-hydroxyethoxy)-phenyl]-2-hydroxy-2-methyl-1-propan-1-one) (Irgacure 2959, trade mark), 1-hydroxy-cyclohexyl-phenyl-ketone (Irgacure 184, trade mark);

(c) phosphorus-containing photoinitiators, including monoacyl and bisacyl phosphine oxide and sulphides, for example 2-4-6-(trimethylbenzoyl)diphenyl-phosphine oxide, bis(2,4,6-trimethylbenzoyl)-phenyl-phosphine oxide (Irgacure 819, trade mark), (2,4,6-trimethylbenzoyl) phenyl phosphinic acid ethyl ester (Lucerin TPO-L (trade mark) ex BASF);

(d) dialkoxy acetophenones;

(e) alpha-haloacetophenones; and (f) trisacyl phosphine oxides.

(g) benzoin and benzoin based photoinitiators (h) thioxanthene based photoinitiators Further suitable radical photo-bleaches are disclosed in WO 9607662 (trisacyl phosphine oxides), U.S. Pat. No. 5,399,782 (phosphine sulphides), U.S. Pat. No. 5,410,060, EP-A-57474, EP-A-73413 (phosphine oxides), EP-A-088050, EP-A-0117233, EP-A-0138754, EP-A-0446175 and U.S. Pat. No. 4,559,371.

Yet further suitable photo-bleaches are disclosed for example in EP-A-0003002 in the name of Ciba Geigy, EP-A-0446175 in the name of Ciba Geigy, GB 2259704 in the name of Ciba Geigy (alkyl bisacyl phosphine oxides), U.S. Pat. No. 4,792,632 (bisacyl phosphine oxides), U.S. Pat. No. 5,554,663 in the name of Ciba Geigy (alpha amino acetophenones), U.S. Pat. No. 5,767,169 (alkoxy phenyl substituted bisacyl phosphine oxides) and U.S. Pat. No. 4,719,297 (acylphosphine compounds).

Radical photo-bleaches are discussed in general in A. F. Cunningham, V. Desorby, K. Dietliker, R. Husler and D. G. Leppard, Chemia 48 (1994) 423-426. They are discussed in H. F. Gruber Prog. Polym. Sci. 17 (1992) 953-1044.

Inorganic photo-bleaches, including titanium dioxide are not excluded, but are less preferred.

Preferred photo-bleaches have a microbicidal or microbistatic function against bacteria and/or fungi. Particularly preferred photo-bleaches show low reactivity with monounsaturated species so as to minimise reactions with the alkyl chains present in conditioner molecules. It is believed that the singlet oxygen photo-bleaches show low reactivity of this type. Where the photo-bleach is anionic in character it should be selected to have a low tendency to complex with the quaternary conditioner molecule with bulkier substituent groups being preferred over less bulky ones.

Pro-Fragrance:

The pro-fragrances used in the present invention may themselves have a characteristic odour or may not.

The reaction of the pro-fragrance with the activated photo-bleach may be a single step reaction which produces the volatile odoriferous component directly or may be one step in a multi-step reaction. A pro-fragrance may produce a single volatile odoriferous component or it may produce a mixture of components. Preferably, the volatile odoriferous component comprises an aldehyde.

Aldehydes used in perfumes include but are not limited to:

phenylacetaldehyde,
p-methyl phenylacetaldehyde,
p-isopropyl phenylacetaldehyde,
methylnonyl acetaldehyde,
phenylpropanal,
3-(4-t-butylphenyl)-2-methyl propanal,
3-(4-t-butylphenyl)-propanal,
3-(4-methoxyphenyl)-2-methylpropanal,
3-(4-isopropylphenyl)-2-methylpropanal,
3-(3,4-methylenedioxyphenyl)-2-methylpropanal,
3-(4-ethylphenyl)-2,2-dimethylpropanal,
phenylbutanal,
3-methyl-5-phenylpentanal,
hexanal,
trans-2-hexenal,
cis-hex-3-enal,
heptanal,
cis-4-heptenal,
2-ethyl-2-heptenal,
2,6-dimethyl-5-heptenal,
2,4-heptadienal,
octanal,
2-octenal,
3,7-dimethyloctanal,
3,7-dimethyl-2,6-octadien-1-al,
3,7-dimethyl-1,6-octadien-3-al,
3,7-dimethyl-6-octenal,
3,7-dimethyl-7-hydroxyoctan-1-al,
nonanal,
6-nonenal,
2,4-nonadienal,
2,6-nonadienal,
decanal,
2-methyl decanal, 4-decenal,
9-decenal,
2,4-decadienal,
undecanal,
2-methyldecanal,
2-methylundecanal,
2,6,10-trimethyl-9-undecenal,
undec-10-enyl aldehyde,
undec-8-enanal,
dodecanal,
tridecanal,
tetradecanal,
anisaldehyde,
bourgeonal,
cinnamic aldehyde,
alpha-amylcinnam-aldehyde,
alpha-hexyl cinnamaldehyde,
methoxy-cinnamaldehyde,
citronellal,
hydroxy-citronellal,
isocyclocitral,
citronellyl
oxyacet-aldehyde,
cortexaldehyde,
cumminic aldehyde,
cyclamen aldehyde,
florhydral,
heliotropin,
hydrotropic aldehyde,
lilial,
vanillin,
ethyl vanillin,
3- and 4-(4-hydroxy-4-methyl-pentyl)-3-cyclohexene-1-carboxaldehyde,
2,4-dimethyl-3-cyclohexene-1-carboxaldehyde,
1-methyl-3-(4-methylpentyl)-3-cyclohexen-carboxaldehyde,
p-methylphenoxyacetaldehyde,
and mixtures thereof.

As noted above, preferred pro-fragrances contain at least one, non-aromatic, C—C double-bond, more preferably at least two C—C double-bonds.

Particularly preferred pro-fragrances comprise the structure (I) below:

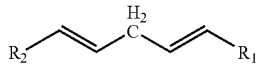

(I)

It is believed that this structure is the site of the reaction with the photo-bleach, $R_1$ and $R_2$ are selected such that fragmentation of the molecule following exposure to the photo-bleach leads to the production of an odoriferous compound, and more preferably at least one of the aldehydes listed above.

One suitable class of pro-fragrance comprises food lipids. Food lipids typically contain structural units with pronounced hydrophobicity. The majority of lipids are derived from fatty acids. In these 'acyl' lipids the fatty acids are predominantly present as esters and include mono-, di-, triacyl glycerols, phospholipids, glycolipids, diol lipids, waxes, sterol esters and tocopherols.

Plant lipids have the necessary complement of antioxidants to prevent their oxidation. During the isolation of oils from plants some of these antioxidants are reduced but sufficient level remains. In the presence of photo-bleaches these antioxidants, including vitamins A (retinol, retinal and retinoic acid and its carotenoid precursors, provitamin A) can be a source of aroma compounds.

Preferred food lipids include amaranth oil, olive oil, palm oil, canola oil, sunflower seed oil, wheat germ oil, almond oil, coconut oil, cocoa butter oil, grape seed oil, rapeseed oil, castor oil, corn oil, cottonseed oil, safflower oil, evening primrose oil, groundnut oil, hemp seed oil, poppy seed oil, palm, palm kernel oil, rice bran oil, sesame oil, soybean oil, pumpkin seed oil, jojoba oil and mustard seed oil.

Preferred food lipids also include oils and fats of animal source including butter, ghee, and squalene. To avoid allergic reaction, certain nut oils (peanut oil, for example) are less preferred.

The most preferred pro-fragrance contain at least 20 wt % of a compound which comprises the moiety

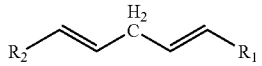

Where R1 and R2 are organic groups containing carbon, hydrogen and oxygen. A preferred example is linoleic acid.

Particularly preferred lipids contain 10 wt % or less of moieties containing three double bonds, (such as linolenic acid). Also the most preferred lipids contain less than 15 wt % saturated acids and less than 15 wt % of acids with less than 14 carbon atoms. Within these preferred limits branched-chain and hydroxyl acid moieties are included.

Most preferred oils exclude those of high linolenic content (preferred <10%), such as hemp oil (~25% wt linolenic acid), and oils of nut origin.

Particularly preferred pro-fragrances are olive oil, sunflower oil, soybean oil, palm oil, canola, rapeseed oil, jojoba, squalene, and mixtures thereof.

The pro-fragrance is preferably present in an amount from 0.01 to 10% by weight, more preferably 0.05 to 5% by weight, most preferably 0.5 to 4.0% by weight, based on the total weight of the composition.

Perfumes

The compositions of the invention preferably comprise one or more perfumes. Typically, both pro-fragrance and perfume will be present. The perfume is preferably present in an amount from 0.01 to 10% by weight, more preferably 0.05 to 5% by weight, most preferably 0.5 to 4.0% by weight, based on the total weight of the composition.

Useful components of the perfume include materials of both natural and synthetic origin. They include single compounds and mixtures. Specific examples of such components may be found in the current literature, e.g., in Fenaroli's Handbook of Flavor Ingredients, 1975, CRC Press; Synthetic Food Adjuncts, 1947 by M. B. Jacobs, edited by Van Nostrand; or Perfume and Flavor Chemicals by S. Arctander 1969, Montclair, N.J. (USA). These substances are well known to the person skilled in the art of perfuming, flavouring, and/or aromatizing consumer products, i.e., of imparting an odour and/or a flavour or taste to a consumer product traditionally perfumed or flavoured, or of modifying the odour and/or taste of said consumer product.

By perfume in this context is not only meant a fully formulated product fragrance, but also selected components of that fragrance, particularly those which are prone to loss, such as the so-called 'top notes'.

Top notes are defined by Poucher (Journal of the Society of Cosmetic Chemists 6(2):80 [1955]). Examples of well known top-notes include citrus oils, linalool, linalyl acetate, lavender, dihydromyrcenol, rose oxide and cis-3-hexanol. Top notes typically comprise 15-25% wt of a perfume composition.

Some or all of the perfume or pro-fragrance may be encapsulated, typical perfume components which it is advantageous to encapsulate, include those with a relatively low boiling point, preferably those with a boiling point of less than 300, preferably 100-250 Celsius and pro-fragrances which can produce such components.

It is also advantageous to encapsulate perfume components which have a low Log P (ie. those which will be partitioned into water), preferably with a Log P of less than 3.0. These materials, of relatively low boiling point and relatively low Log P have been called the "delayed blooming" perfume ingredients and include the following materials:

Allyl Caproate, Amyl Acetate, Amyl Propionate, Anisic Aldehyde, Anisole, Benzaldehyde, Benzyl Acetate, Benzyl Acetone, Benzyl Alcohol, Benzyl Formate, Benzyl Iso Valerate, Benzyl Propionate, Beta Gamma Hexenol, Camphor Gum, Laevo-Carvone, d-Carvone, Cinnamic Alcohol, Cinnamyl Formate, Cis-Jasmone, cis-3-Hexenyl Acetate, Cuminic Alcohol, Cyclal C, Dimethyl Benzyl Carbinol, Dimethyl Benzyl Carbinol Acetate, Ethyl Acetate, Ethyl Aceto Acetate, Ethyl Amyl Ketone, Ethyl Benzoate, Ethyl Butyrate, Ethyl Hexyl Ketone, Ethyl Phenyl Acetate, Eucalyptol, Eugenol, Fenchyl Acetate, Flor Acetate (tricyclo Decenyl Acetate), Frutene (tricycico Decenyl Propionate), Geraniol, Hexenol, Hexenyl Acetate, Hexyl Acetate, Hexyl Formate, Hydratropic Alcohol, Hydroxycitronellal, Indone, Isoamyl Alcohol, Iso Menthone, Isopulegyl Acetate, Isoquinolone, Ligustral, Linalool, Linalool Oxide, Linalyl Formate, Menthone, Menthyl Acetophenone, Methyl Amyl Ketone, Methyl Anthranilate, Methyl Benzoate, Methyl Benzyl Acetate, Methyl Eugenol, Methyl Heptenone, Methyl Heptine Carbonate, Methyl Heptyl Ketone, Methyl Hexyl Ketone, Methyl Phenyl Carbinyl Acetate, Methyl Salicylate, Methyl-N-Methyl Anthranilate, Nerol, Octalactone, Octyl Alcohol, p-Cresol, p-Cresol Methyl Ether, p-Methoxy Acetophenone, p-Methyl Acetophenone, Phenoxy Ethanol, Phenyl Acetaldehyde, Phenyl Ethyl Acetate, Phenyl Ethyl Alcohol, Phenyl Ethyl Dimethyl Carbinol, Prenyl Acetate, Propyl Bornate, Pulegone, Rose Oxide, Safrole, 4-Terpinenol, Alpha-Terpinenol, and/or Viridine Preferred perfume ingredients are those hydrophobic perfume components with a ClogP above 3, preferably between 3-5, more preferably between 4-5. As used herein, the term "ClogP" means the logarithm to base 10 of the octanol/water partition coefficient (P). The octanol/water partition coefficient of a PRM is the ratio between its equilibrium concentrations in octanol and water. Given that this measure is a ratio of the equilibrium concentration of a PRM in a non-polar solvent (octanol) with its concentration in a polar solvent (water), ClogP is also a measure of the hydrophobicity of a material—the higher the ClogP value, the more hydrophobic the material. ClogP values can be readily calculated from a program called "CLOGP" which is available from Daylight Chemical Information Systems Inc., Irvine Calif., USA. Octanol/water partition coefficients are described in more detail in U.S. Pat. No. 5,578,563.

Perfume components with a ClogP above 3 comprise: Iso E super, citronellol, Ethyl cinnamate, Bangalol, 2,4,6-Trimethylbenzaldehyde, Hexyl cinnamic aldehyde, 2,6-Dimethyl-2-heptanol, Diisobutylcarbinol, Ethyl salicylate, Phenethyl isobutyrate, Ethyl hexyl ketone, Propyl amyl ketone, Dibutyl ketone, Heptyl methyl ketone, 4,5-Dihydrotoluene, Caprylic aldehyde, Citral, Geranial, Isopropyl benzoate, Cyclohexanepropionic acid, Campholene aldehyde, Caprylic acid, Caprylic alcohol, Cuminaldehyde, 1-Ethyl-4-nitrobenzene, Heptyl formate, 4-Isopropylphenol, 2-Isopropylphenol, 3-Isopropylphenol, Allyl disulfide, 4-Methyl-1-phenyl-2-pentanone, 2-Propylfuran, Allyl caproate, Styrene, Isoeugenyl methyl ether, Indonaphthene, Diethyl suberate, L-Menthone, Menthone racemic, p-Cresyl isobutyrate, Butyl butyrate, Ethyl hexanoate, Propyl valerate, n-Pentyl propanoate, Hexyl acetate, Methyl heptanoate, trans-3,3,5-Trimethylcyclohexanol, 3,3,5-Trimethylcyclohexanol, Ethyl p-anisate, 2-Ethyl-1-hexanol, Benzyl isobutyrate, 2,5-Dimethylthiophene, Isobutyl 2-butenoate, Caprylnitrile, gamma-Nonalactone, Nerol, trans-Geraniol, 1-Vinylheptanol, Eucalyptol, 4-Terpinenol, Dihydrocarveol, Ethyl 2-methoxybenzoate, Ethyl cyclohexanecarboxylate, 2-Ethylhexanal, Ethyl amyl carbinol, 2-Octanol, 2-Octanol, Ethyl methylphenylglycidate, Diisobutyl ketone, Coumarone, Propyl isovalerate, Isobutyl butanoate, Isopentyl propanoate, 2-Ethylbutyl acetate, 6-Methyl-tetrahydroquinoline, Eugenyl methyl ether, Ethyl dihydrocinnamate, 3,5-Dimethoxytoluene, Toluene, Ethyl benzoate, n-Butyrophenone, alpha-Terpineol, Methyl 2-methylbenzoate, Methyl 4-methylbenzoate, Methyl 3, methylbenzoate, sec.Butyl n-butyrate, 1,4-Cineole, Fenchyl alcohol, Pinanol, cis-2-Pinanol, 2,4, Dimethylacetophenone, Isoeugenol, Safrole, Methyl 2-octynoate, o-Methylanisole, p-Cresyl methyl ether, Ethyl anthranilate, Linalool, Phenyl butyrate, Ethylene glycol dibutyrate, Diethyl phthalate, Phenyl mercaptan, Cumic alcohol, m-Toluquinoline, 6-Methylquinoline, Lepidine, 2-Ethylbenzaldehyde, 4-Ethylbenzaldehyde, o-Ethylphenol, p-Ethylphenol, m-Ethylphenol, (+)-Pulegone, 2,4-Dimethylbenzaldehyde, Isoxylaldehyde, Ethyl sorbate, Benzyl propionate, 1,3-Dimethylbutyl acetate, Isobutyl isobutanoate, 2,6-Xylenol, 2,4-Xylenol, 2,5-Xylenol, 3,5-Xylenol, Methyl cinnamate, Hexyl methyl ether, Benzyl ethyl ether, Methyl salicylate, Butyl propyl ketone, Ethyl amyl ketone, Hexyl methyl ketone, 2,3-Xylenol, 3,4, Xylenol, Cyclopentadenanolide and Phenyl ethyl 2 phenylacetate 2.

It is commonplace for a plurality of perfume components to be present in a formulation. In the compositions of the present invention it is envisaged that there will be four or more, preferably five or more, more preferably six or more or even seven or more different perfume components from the list given of delayed blooming perfumes given above and/or the list of perfume components with a ClogP above 3 present in the perfume.

Another group of perfumes with which the present invention can be applied are the so-called 'aromatherapy' materials. These include many components also used in perfumery, including components of essential oils such as Clary Sage, Eucalyptus, Geranium, Lavender, Mace Extract, Neroli, Nutmeg, Spearmint, Sweet Violet Leaf and Valerian. By means of the present invention these materials can be transferred to textile articles that will be worn or otherwise come into contact with the human body (such as handkerchiefs and bedlinen).

Quaternary Ammonium Fabric Conditioner

The preferred quaternary ammonium fabric conditioner for use in compositions of the present invention are so called "ester quats".

Particularly preferred materials are the ester-linked triethanolammonium (TEA) quaternary ammonium compounds comprising a mixture of mono-, di- and tri-ester linked components.

Typically, TEA-based fabric softening compounds comprise a mixture of mono, di- and tri-ester forms of the compound where the di-ester linked component comprises no more than 70% by weight of the fabric softening compound, preferably no more than 60%, e.g. no more than 55%, or even no more than 45% of the fabric softening compound. Preferably there is at least 10% of the monoester linked component present.

A first group of quaternary ammonium compounds (QACs) suitable for use in the present invention is represented by formula (I):

$$[(CH_2)_n(TR)]_m—(R^1).N^+—[(CH_2)_n(OH)]_{3-m}X^- \quad (I)$$

wherein each R is independently selected from a $C_{5-35}$ alkyl or alkenyl group; $R^1$ represents a $C_{1-4}$ alkyl, $C_{2-4}$ alkenyl or a $C_{1-4}$ hydroxyalkyl group; T is generally O—CO. (i.e. an ester group bound to R via its carbon atom), but may alternatively be CO.O (i.e. an ester group bound to R via its oxygen atom); n is a number selected from 1 to 4; m is a number selected from 1, 2, or 3; and $X^-$ is an anionic counter-ion, such as a halide or alkyl sulphate, e.g. chloride or methylsulphate. Di-esters variants of formula I (i.e. m=2) are preferred and typically have mono- and tri-ester analogues associated with them. Such materials are particularly suitable for use in the present invention.

Especially preferred agents are preparations which are rich in the di-esters of triethanolammonium salts otherwise referred to as "TEA ester quats". These typically comprise the salts of the di-[fatty ester] of triethanolamide, where the fatty chains are $C_{10}$-$C_{20}$ Commercial examples include Prapagen™ TQL, ex Clariant, and Tetranyl™ AHT-1, ex Kao, (both di-[hardened tallow ester] of triethanolammonium methylsulphate), AT-1 (di-[tallow ester] of triethanolammonium methylsulphate), and L5/90 (di-[palm ester] of triethanolammonium methylsulphate), both ex Kao, and Rewoquat™ WE15 (a di-ester of triethanolammonium methylsulphate having fatty acyl residues deriving from $C_{10}$-$C_{20}$ and $C_{16}$-$C_{18}$ unsaturated fatty acids), ex Witco Corporation.

A second group of QACs suitable for use in the invention is represented by formula (II):

$$(R^1)_2—N^+—[(CH_2)_n\text{-}T\text{-}R^2]_2X^- \quad (II)$$

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and n, T, and $X^-$ are as defined above. Preferred materials of this third group include bis-(2-tallowoyloxyethyl)-dimethyl ammonium chloride (DEEDMAC) and hardened versions thereof.

A third group of QAC's suitable for use in the invention are non-esters represented by formula (II):

$$(R^1)_2—N^+—[(CH_2)_nR^2]_2X^- \quad (II)$$

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and n, and $X^-$ are as defined above. Preferred materials of this third group include bis(2-alkyl)dimethyl ammonium chloride and hardened versions thereof, including commercially available materials such as Arquad 2HT.

The iodine value of the quaternary ammonium fabric conditioning material is preferably from 0 to 80, more preferably from 0 to 60, and most preferably from 0 to 45. Essentially saturated material, i.e. having an iodine value of from 0 to 1, is used in especially high performing compositions. At low iodine values, the softening performance is excellent and the composition has improved resistance to oxidation and associated odour problems upon storage. Low iodine values are also preferred in the presence of the photo-bleaches of the present invention. While some reaction between the fatty chains of the fabric conditioners and the photo-bleach can be accommodated, and may even lead to the development of fragrance components, it is preferred that this only occurs at a low level, and that largely (less than 10% total 18:1 and 18:2) or effectively fully saturated conditioners are employed.

Iodine value is defined as the number of grams of iodine absorbed per 100 g of test material. NMR spectroscopy is a suitable technique for determining the iodine value of the softening agents of the present invention, using the method described in *Anal. Chem.,* 34, 1136 (1962) by Johnson and Shoolery and in EP 593,542 (Unilever, 1993).

The conditioning agent is preferably present in the compositions of the invention at a level of 2% to 40% by weight of the total composition, more preferably from 4% to 30%.

Co-softeners may be used. When employed, they are typically present at from 0.1 to 20% and particularly at from 0.5 to 10%, based on the total weight of the composition. Preferred co-softeners include fatty esters, and fatty N-oxides. Fatty esters that may be employed include fatty monoesters, such as glycerol monostearate, fatty sugar esters, such as those disclosed WO 01/46361 (Unilever).

The compositions of the present invention will preferably comprise a fatty complexing agent.

Especially suitable fatty complexing agents include fatty alcohols and fatty acids. Of these, fatty alcohols are most preferred.

Without being bound by theory it is believed that the fatty complexing material improves the viscosity profile of the composition by complexing with mono-ester component of the fabric conditioner material thereby providing a composition which has relatively higher levels of di-ester and tri-ester linked components. The di-ester and tri-ester linked components are more stable and do not affect initial viscosity as detrimentally as the mono-ester component.

It is also believed that the higher levels of mono-ester linked component present in compositions comprising quaternary ammonium materials based on TEA may destabilise the composition through depletion flocculation. By using the fatty complexing material to complex with the mono-ester linked component, depletion flocculation is significantly reduced.

In other words, the fatty complexing agent at the increased levels, as required by the present invention, "neutralises" the mono-ester linked component of the quaternary ammonium material. This in situ di-ester generation from mono-ester and fatty alcohol also improves the softening of the composition.

Preferred fatty acids include hardened tallow fatty acid (available under the tradename Pristerene™, ex Uniqema). Preferred fatty alcohols include hardened tallow alcohol (available under the tradenames Stenol™ and Hydrenol™, ex Cognis and Laurex™ CS, ex Albright and Wilson).

The fatty complexing agent is preferably present in an amount greater than 0.3 to 5% by weight based on the total weight of the composition. More preferably, the fatty component is present in an amount of from 0.4 to 4%. The weight ratio of the mono-ester component of the quaternary ammonium fabric softening material to the fatty complexing agent is preferably from 5:1 to 1:5, more preferably 4:1 to 1:4, most preferably 3:1 to 1:3, e.g. 2:1 to 1:2.

It is preferred that the compositions further comprise a nonionic surfactant. Typically these can be included for the purpose of stabilising the compositions.

Suitable nonionic surfactants include addition products of ethylene oxide and/or propylene oxide with fatty alcohols, fatty acids and fatty amines. Any of the alkoxylated materials of the particular type described hereinafter can be used as the nonionic surfactant.

Suitable surfactants are substantially water soluble surfactants of the general formula:

$$R—Y—(C_2H_4O)_z—CH_2—CH_2—OH$$

where R is selected from the group consisting of primary, secondary and branched chain alkyl and/or acyl hydrocarbyl groups having a chain length of from 8 to about 25, preferably 10 to 20, e.g. 14 to 18 carbon atoms.

In the general formula for the ethoxylated nonionic surfactant, Y is typically:

—O—, —C(O)O—, —C(O)N(R)— or —C(O)N(R)
R— in which R has the meaning given above or can be hydrogen; and Z is at least about 8, preferably at least about 10 or 11.

Preferably the nonionic surfactant has an HLB of from about 7 to about 20, more preferably from 10 to 18, e.g. 12 to 16.

Genapol™ C200 (Clariant) based on coco chain and 20 EO groups is an example of a suitable nonoionic surfactant.

The nonionic surfactant is present in an amount from 0.01 to 10%, more preferably 0.1 to 5 by weight, based on the total weight of the composition.

As the compositions of the present invention are intended to be used as rinse conditioners they will be effectively free of anionic surfactants such as LAS.

Particularly preferred compositions according to the present invention are fabric conditioner compositions comprising:

a) a singlet oxygen photo-bleach;
b) a quaternary ammonium fabric conditioner, comprising a salt of the di-[C10-C20 ester] of triethanololamide and being essentially free of 1,2 bis[hardened tallowoyloxy]-3-thrimethylammoniumpropane chloride; and,
c) perfume and/or pro-fragrance.

Shading Dyes

As noted above, an optional shading dye can be used to counteract the tendency of the photo-bleach to move the hue of fabrics away from white. Preferred dyes are violet or blue. Suitable and preferred classes of dyes are discussed below. Moreover the unsaturated quaternary ammonium conditioners are subject to some degree of UV light and/or transition metal ion catalysed radical auto-oxidation, with an attendant risk of yellowing of fabric. The presence of a shading dye advantageously reduces the risk of yellowing from this source.

Direct Dyes

Direct dyes (otherwise known as substantive dyes) are the class of water soluble dyes which have a affinity for fibres and are taken up directly. Direct violet and direct blue dyes are preferred.

Preferably the dye are bis-azo or tris-azo dyes are used.

Most preferably, the direct dye is a direct violet of the following structures:

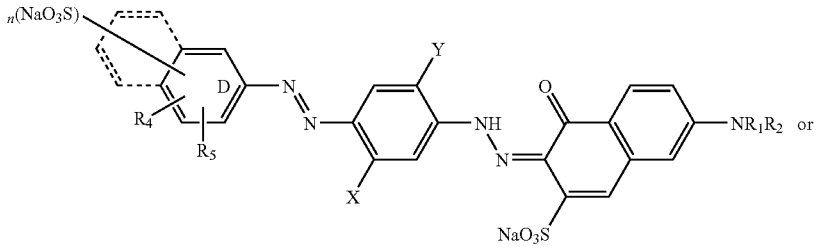

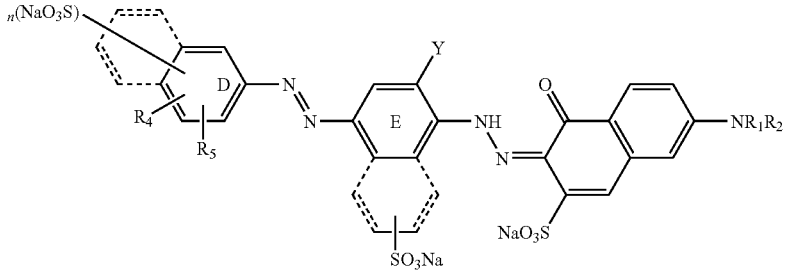

wherein:

ring D and E may be independently naphthyl or phenyl as shown;

$R_1$ is selected from: hydrogen and C1-C4-alkyl, preferably hydrogen;

$R_2$ is selected from: hydrogen, C1-C4-alkyl, substituted or unsubstituted phenyl and substituted or unsubstituted naphthyl, preferably phenyl;

$R_3$ and $R_4$ are independently selected from: hydrogen and C1-C4-alkyl, preferably hydrogen or methyl;

X and Y are independently selected from: hydrogen, C1-C4-alkyl and C1-C4-alkoxy; preferably the dye has X=methyl; and, Y=methoxy and n is 0, 1 or 2, preferably 1 or 2.

Preferred dyes are direct violet 7, direct violet 9, direct violet 11, direct violet 26, direct violet 31, direct violet 35, direct violet 40, direct violet 41, direct violet 51, and direct violet 99. Bis-azo copper containing dyes such as direct violet 66 may be used.

The benzidene based dyes are less preferred.

Preferably the direct dye is present at 0.00001 wt % to 0.01 wt % of the formulation.

In another embodiment the direct dye may be covalently linked to the photo-bleach, for example as described in WO2006/024612.

Acid Dyes

Cotton substantive acid dyes give benefits to cotton containing garments. Preferred dyes and mixes of dyes are blue or violet. Preferred acid dyes are:

(i) azine dyes, wherein the dye is of the following core structure:

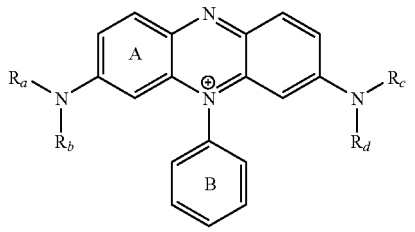

wherein $R_a$, $R_b$, $R_c$ and $R_d$ are selected from: H, an branched or linear C1 to C7-alkyl chain, benzyl a phenyl, and a naphthyl;

the dye is substituted with at least one $SO_3^-$ or —$COO^-$ group;

the B ring does not carry a negatively charged group or salt thereof;

and the A ring may further substituted to form a naphthyl;

the dye is optionally substituted by groups selected from: amine, methyl, ethyl, hydroxyl, methoxy, ethoxy, phenoxy, Cl, Br, I, F, and $NO_2$.

Preferred azine dyes are: acid blue 98, acid violet 50, and acid blue 59, more preferably acid violet 50 and acid blue 98.

Other preferred non-azine acid dyes are acid violet 17, acid black 1 and acid blue 29.

Preferably the acid dye is present at 0.0005 wt % to 0.01 wt % of the formulation.

Hydrophobic Dyes

The composition may comprise one or more hydrophobic dyes selected from benzodifuranes, methine, triphenylmethanes, napthalimides, pyrazole, napthoquinone, anthraquinone and mono-azo or di-azo dye chromophores. Hydrophobic dyes are dyes which do not contain any charged water solubilising group. Hydrophobic dyes may be selected from the groups of disperse and solvent dyes. Blue and violet anthraquinone and mono-azo dye are preferred.

Preferred dyes include solvent violet 13, disperse violet 27 disperse violet 26, disperse violet 28, disperse violet 63 and disperse violet 77.

Preferably the hydrophobic dye is present at 0.0001 wt % to 0.005 wt % of the formulation.

Basic Dyes

Basic dyes are organic dyes which carry a net positive charge. They deposit onto cotton. They are of particular utility for used in composition that contain predominantly cationic surfactants. Dyes may be selected from the basic violet and basic blue dyes listed in the Colour Index International.

Preferred examples include triarylmethane basic dyes, methane basic dye, anthraquinone basic dyes, basic blue 16, basic blue 65, basic blue 66, basic blue 67, basic blue 71, basic blue 159, basic violet 19, basic violet 35, basic violet 38, basic violet 48; basic blue 3, basic blue 75, basic blue 95, basic blue 122, basic blue 124, basic blue 141. Other thiazolium dyes besides basic blue 66 may also be used.

Reactive Dyes

Reactive dyes are dyes which contain an organic group capable of reacting with cellulose and linking the dye to cellulose with a covalent bond. They deposit onto cotton.

Preferably the reactive group is hydrolysed or reactive group of the dyes has been reacted with an organic species such as a polymer, so as to the link the dye to this species. Dyes may be selected from the reactive violet and reactive blue dyes listed in the Colour Index International.

Preferred examples include reactive blue 19, reactive blue 163, reactive blue 182 and reactive blue, reactive blue 96.

Dye Conjugates

Dye conjugates are formed by binding direct, acid or basic dyes to polymers or particles via physical forces.

Dependent on the choice of polymer or particle they deposit on cotton or synthetics. A description is given in WO2006/055787. They are not preferred.

Particularly preferred dyes are: direct violet 7, direct violet 9, direct violet 11, direct violet 26, direct violet 31, direct violet 35, direct violet 40, direct violet 41, direct violet 51, direct violet 99, acid blue 98, acid violet 50, acid blue 59, acid violet 17, acid black 1, acid blue 29, solvent violet 13, disperse violet 27 disperse violet 26, disperse violet 28, disperse violet 63, disperse violet 77 and mixtures thereof.

In a preferred embodiment, the conditioner compositions of the present invention comprise:

a) photo-bleach, preferably phthalocyanine, preferably at a level of 0.00001-0.05 wt %,
b) perfume and/or pro-fragrance, preferably at a level of 0.1-10% wt, and,
c) a blue violet dye, preferably with an optical adsorption peak in the range 540-600 nm, preferably a bis-azo direct dye, preferably at a level of 0.00001-0.01 wt %.

In a particularly preferred embodiment, the conditioner compositions of the present invention comprise:

a) photo-bleach, which is a blue violet dye, preferably with an optical adsorption peak in the range 540-600 nm, preferably with an optical adsorption peak in the range 540-600 nm, preferably at a level of 0.00001-0.05 wt %,
b) perfume and/or pro-fragrance, preferably at a level of 0.1-10% wt, and, Further Optional Ingredients The compositions of the invention may contain one or more other ingredients. Such ingredients include further preservatives (e.g. bactericides), pH buffering agents, perfume carriers, hydrotropes, anti-redeposition agents, soil-release agents, polyelectrolytes, anti-shrinking agents, anti-wrinkle agents, anti-oxidants, sunscreens, anti-corrosion agents, drape imparting agents, anti-static agents and ironing aids. The products of the invention preferably contain pearlisers and/or opacifiers.

It is believed that those polymers which deposit on cloth as a part of their activity may assist in the deposition of the pro-fragrance, perfume generated from the pro-fragrance and/or other perfume components present. These include cationic polymeric deposition aids. Suitable cationic polymeric deposition aids include cationic guar polymers such as Jaguar™ (ex Rhone Poulenc), cationic cellulose derivatives such as Celquats™ (ex National Starch), Flocaid™ (ex National Starch), cationic potato starch such as SoftGel™ (ex Aralose), cationic polyacrylamides such as PCG (ex Allied Colloids).

Particularly preferred conditioner compositions according to the present invention are free of fluorescer and comprise:

a) at least one photo-bleach, preferably phthalocyanine, preferably at a level of 0.00001-0.05 wt %
b) at least one pro-fragrance, preferably at a level of 0.001 to 10 wt %, more preferably 0.1 to 2 wt %
c) at least one shading dye, preferably a bis-azo direct dye, preferably with an optical adsorption peak in the range 540-600 nm, preferably at a level of 0.00001-0.01 wt %;
d) perfume, preferably at a level of 0.001 to 10 wt %, more preferably 0.1 to 2 wt %;
e) optionally, a polymeric deposition aid for the pro-fragrance and/or perfume.

To prevent photo-activation of the photo-bleach in the bottle, a photo-stable dye may be added to the formulation to shield the photo-bleach from light. Preferably this dye is not substantive to the fabric and therefore does not prevent photo-bleach activation on cloth. In the alternative, clear bottles may include a UV filter but as many of the photo-bleaches are activated by visible light it is possible to use opaque bottles or select, for example photo-stable components or a combination of the two.

Product Form

A composition of the invention may be in dry solid or liquid form. The composition may be a concentrate to be diluted, rehydrated and/or dissolved in a solvent, including water, before use. The composition may also be a ready-to-use (in-use) composition. Preferably the composition is provided as a ready to use liquid comprising an aqueous phase. The aqueous phase may comprise water-soluble species, such as mineral salts or short chain ($C_{1-4}$) alcohols.

The mineral salts may aid the attainment of the required phase volume for the composition, as may water soluble organic salts and cationic deflocculating polymers, as described in EP 41,698 A2 (Unilever). Such salts may be present at from 0.001 to 1% and preferably at from 0.005 to 0.1% by weight of the total composition. Examples of suitable mineral salts for this purpose include calcium chloride and magnesium chloride. The compositions of the invention may also contain pH modifiers such as hydrochloric acid. The short chain alcohols include primary alcohols, such as ethanol, propanol, and butanol, and secondary alcohols such as isopropanol. The short chain alcohol may be added with the cationic softening agent during the preparation of the composition.

The composition is preferably used in the rinse cycle of a home textile laundering operation, where, it may be added directly in an undiluted state to a washing machine, e.g. through a dispenser drawer or, for a top-loading washing machine, directly into the drum. Alternatively, it can be diluted prior to use. The compositions may also be used in a domestic hand-washing laundry operation.

It is also possible, though less desirable, for the compositions of the present invention to be used in industrial laundry operations, e.g. as a finishing agent for softening new clothes prior to sale to consumers.

Method of Manufacture

In a typical method of manufacture, the cationic softening agent, and any optional components such as co-softener are heated together until a co-melt is formed. Water and other components are heated and the co-melt is added to the water with stirring. The phase volume of the disperse phase may be reduced by the addition of an electrolyte and/or by milling, preferably whilst the mixture is still hot.

The addition of pro-fragrance may be as a co-melt with the actives, as a separate addition stage similar to the addition of perfume, that is, at the end of the process stage when the batch is cooled or post dosed at the end of the process as a pre-formed emulsion with the perfume of the formulation. The preferred method of pro-fragrance addition is to make a mixture of the pro-fragrance with the composition perfume and add this oily mixture at the end of the process. This prevents the possible degradation of the pro-fragrance and protects it from the high temperature processing.

In order that the invention will be further understood it is described below with reference to the following examples:

EXAMPLES

Example 1

Photo-Bleach Interaction with Lipid Pro-Fragrances

20% emulsions of the lipids were prepared in a bench-top jacketed mixer using a three-blade impeller at 500 RPM and a process temperature of 50° C. The lipids were heated to ~50° C. and added drop-wise into a 1% solution of non-ionic surfactant (Genapol™ LA 070, ex Clariant). After sufficient mixing the batch was cooled slowly to room temperature and the emulsion decanted into a bottle and further treated in a Silverson high shear homogeniser (one minute mixing at the lowest speed setting).

Cotton sheeting monitors roughly 20×20 cm were padded with these emulsions in the following manner. A 500 ml glass bottle filled with 200 g of tap water to which 20 or 10 g of the above 20% emulsion was weighed in and shaken. To this a fixed level of photo-bleach was weighed in and shaken. Then two monitors were added and agitated on a roller for some 30 minutes. The monitors then removed and spin dried. From the monitor's dry and wet weight and the concentration of emulsion the amount of lipid (emulsion) could be calculated.

TABLE 1

Amount of lipid picked up by monitors for 20 g of emulsion and an average 0.090 mg of Acid Red 51 per g of fabric.

| Lipids | dry weight/g | padded weight/g | pick up/g | Mg oil/g fabric |
|---|---|---|---|---|
| Soy oil | 12.56 | 27.37 | 14.81 | 21.44 |
| Ryoto ester ER290 | 12.52 | 27.24 | 14.72 | 21.31 |
| Soy oil sugar ester | 12.44 | 27.06 | 14.62 | 21.16 |
| Estol 1476 | 12.7 | 27.62 | 14.92 | 21.60 |
| Sirius M40 | 13.09 | 28.03 | 14.94 | 21.63 |
| Extra virgin olive oil | 15.08 | 32.51 | 17.43 | 25.23 |
| Palm and Canola oil | 15.63 | 32.51 | 16.88 | 24.44 |
| Coconut oil | 15.18 | 32.64 | 17.46 | 25.28 |
| Squalene | 15.16 | 31.83 | 16.67 | 24.13 |

Acid Red 51 is erythrosine B (ex Aldrich). Ryoto ester is a food grade sucrose ester oil based on erucate (22:1) lipid source (ex Mitsubishi). Soy oil sucrose ester is touch hardened oil (ex Clariant). The sucrose esters have an average of 4 ester linkage. Estol 1476 is isobutyl stearate (ex Uniqema). Sirius M40 is a mainly C12-C20 light mineral oil (ex Silkolene) Squalene is a polyunsaturated triterpene ($C_{30}$) oil (ex Sigma). The remaining oils were purchased off the shelf from supermarkets (Tesco).

TABLE 2

Amount of lipid picked up by monitors for 10 g of emulsion for two photobleach treatments of an average of 0.090 mg of Acid Red 51 and an average of 0.246 mg of pentyl-phenyl ketone per g of fabric.

| Lipids | dry weight/g | padded weight/g | pick up/g | mg oil/g fabric |
|---|---|---|---|---|
| Ghee | 12.74 | 27.76 | 15.02 | 11.23 |
| Grapeseed oil | 12.72 | 27.59 | 14.87 | 11.13 |
| Hemp oil | 12.11 | 26.11 | 14.00 | 11.01 |
| Sunflower oil | 12.08 | 26.05 | 13.97 | 11.01 |
| Rapeseed oil | 12.04 | 26.62 | 14.58 | 11.53 |

TABLE 2-continued

Amount of lipid picked up by monitors for 10 g of emulsion for two photobleach treatments of an average of 0.090 mg of Acid Red 51 and an average of 0.246 mg of pentyl-phenyl ketone per g of fabric.

| Lipids | dry weight/g | padded weight/g | pick up/g | mg oil/g fabric |
|---|---|---|---|---|
| Cocoa Soft | 12.26 | 27.73 | 15.47 | 12.02 |
| Pumpkin oil | 12.16 | 27.98 | 15.82 | 12.39 |
| Sweet almond oil | 12.31 | 26.79 | 14.48 | 11.20 |
| Castor oil | 12.32 | 27.60 | 15.28 | 11.81 |
| Jojoba oil | 12.10 | 26.26 | 14.16 | 11.15 |

Pentyl-phenyl ketone or hexanophenone is a radical photobleach (ex Aldrich). Cocoa Soft was Lipex Cococasoft (ex AAK). Castor oil was a pure grade (ex Now). Jojoba oil was (ex Henry Lamotte). The Sweet almond oil was (ex Provital SA). The remaining oils purchased off the shelf from a supermarket (Tesco).

The two monitors treated for each lipid and each photobleach were dried one on line (inside) and one in Weather-o-meter™ (WOM) for 30 minutes. WOM produces artificial sunlight and was set up to give 385 W/m$^2$ in the UV-visible range (290-750 nm).

Monitor 1 was the line dried control (C) against which the Weather-o-meter monitor 2 (W) was judged. The monitors were kept in closed top bottles under florescent light condition to be presented to panel members to evaluate the quality of the odours in the headspace and on the monitors. The odour descriptors used were based on those known in the art. The panel members described the odour and assigned a number to quantify the intensity of the odour they perceived.

The odour comparison between the saturated oil Estol 1476 and Sirius M40 and the oils containing unsaturation revealed that the Weather-o-meter irradiated samples of the unsaturated lipids from the start had developed a sharp "ozonic", bleach type penetrating odour labelled as "pungent". It is not necessarily an unpleasant odour and at low levels most of the time connoted a 'clean' fabric note not dissimilar to outside line dried laundried fabrics.

TABLE 3

Odour description of oils same day for line dried (C) and weather-o-meter dried (W).

| | Olive oil | | Palm & Canola | | Coconut oil | | Squalene | |
|---|---|---|---|---|---|---|---|---|
| | Treatment | | | | | | | |
| Odour | C | W | C | W | C | W | C | W |
| Fruity | | 1 | | | | | | 2* |
| Green | | | 1 | | | | | 2 |
| Clean | | 1 | 1 | | 1 | | | 1 |
| Soapy | | | | | 1 | | 1 | 1 |
| Dairy | | | | | | | | |
| Pungent | | 2 | | 2 | | | | 1 |
| Oily | 1 | 1 | 2 | 2 | | 2 | 1 | |
| Tallowy | | | | 1 | | | | |
| Frying oil | | | | 1 | | 2 | | |
| Stale nut | | | | | | | | |
| Fishy | | | | | | | | |

More pleasant odours are at the top of the table. (*= honey caramel, **= sweet).

TABLE 4

Odour description after one day standing under fluorescent light.

| | Olive oil | | Palm & Canola | | Coconut oil | | Squalene | |
|---|---|---|---|---|---|---|---|---|
| | treatment | | | | | | | |
| Odour | C | W | C | W | C | W | C | W |
| Fruity | | | | 1 | | | 1** | 2* |
| Green | | | | | | | | 1 |
| Clean | 1 | 1 | | | 1 | | 1 | 1 |
| Soapy | 1 | 1 | 1 | 1 | 1 | | | 1 |
| Dairy | | | | | | | | |
| Pungent | | 3 | | | | 1 | | 1.5 |
| Oily | 2 | 1 | 1 | 1 | 1 | 0.5 | 1 | |
| Tallowy | | | 1 | 1 | 1 | 0.5 | | |
| Frying oil | | | | | | | | |
| Stale nut | | | | 1 | 1 | | | |
| Fishy | | | | | | | | |

More pleasant odours are at the top of the table.

The light induced oxidation products of squalene were particularly noteworthy in their distinct and unmistakable potent perfume quality.

TABLE 5

Odour description and intensity of oils with Red Acid 51 photo bleach first day.

| | Ghee | | Grapeseed Oil | | Hemp Oil | | Sunflower Oil | | Rapeseed oil | |
|---|---|---|---|---|---|---|---|---|---|---|
| | treatment | | | | | | | | | |
| Odour | C | W | C | W | C | W | C | W | C | W |
| Fruity | | | | | | | | | 1 | 1 |
| Green | | | | | | | 2 | | | |
| Clean | 1 | | | | | | | | | |
| Soapy | | 1 | | | | | | | 1 | 1 |
| Dairy | | 2 | | | | | | | | |
| Pungent | | 2 | | 1 | | | | | | |
| Oily | | | 1 | 2 | | | 1 | 1 | 1 | 1 |
| Tallowy | | | | | | | | | | |
| Frying oil | | | | | | | | | | |
| Stale nut | | | | | | | | 2 | | |
| Fishy | | | | | 2 | 3 | | | | |

| | Cocoasoft | | Pumpkin oil | | Sweet Almond | | Castor oil | | Jojoba oil | |
|---|---|---|---|---|---|---|---|---|---|---|
| | treatment | | | | | | | | | |
| | C | W | C | W | C | W | C | W | C | W |
| Fruit | | 0.5 | | 0.5 | | | 0.5 | | | |
| Green | 0.5 | | 0.5 | 1.5 | | | 1.5 | | 0.5 | |
| Clean | 0.5 | 1 | | | 1 | | 1.5 | 1 | 1.5 | 2 |
| Soap | 0.5 | | 0.5 | | 1 | | | | | 1.5 |
| Dairy | 1 | | | | | | | | | |
| Pungent | | 0.5 | | 1.5 | | 1 | | 0.5 | | 1.5 |
| Oily | | 0.5 | | | | 0.5 | | 0.5 | | |
| Tallowy | | | 0.5 | | | | | | | |
| Frying oil | | 1 | 2 | 2.5 | | | | 1 | | |
| Stale nut | | 0.5 | 1.5 | 2 | | | | | | |
| Fish | | | | | | | | | | |

More pleasant odours are at the top of the table.

TABLE 6

Odour description and intensity of oils with of 0.246 mg of phentyl-phenyl ketone per g of fabric.

| | Ghee | | Grapeseed | | Hemp | | Sunflower | | Rapeseed | |
|---|---|---|---|---|---|---|---|---|---|---|
| | treatment | | | | | | | | | |
| | C | W | C | W | C | W | C | W | C | W |
| Fruity | | | 1 | | | 1 | 1 | | 1 | |
| Green | | | | | | | 1 | | 2 | 1 |
| Clean | | | | | | | 1 | | 2 | |
| Soapy | 1 | | | 2 | | | 1 | | | |
| Dairy | 1 | 2.5 | | 0 | | | 1 | 1 | | 1.5 |
| Pungent | | | | | | | | | | |
| Oily | 1 | | | | | | | | | |
| Tallowy | | | | | | | | | | |
| Frying oil | | | | | | | | 2 | | |
| Stale Nut | | | | | | | | | | |
| Fish | | | | | 2 | 2 | | | | |

| | Cocoasoft | | Pumpkin oil | | Sweet Almond | | Castor oil | | Jojoba oil | |
|---|---|---|---|---|---|---|---|---|---|---|
| | treatment | | | | | | | | | |
| | C | W | C | W | C | W | C | W | C | W |
| Fruity | 1 | | | | 1 | | 1 | | 1 | |
| Green | | | 1 | | | | | | | 2 |
| Clean | | | | | 1 | | | | | |
| Soapy | | 1 | | | | | | 2 | | 2 |
| Dairy | | 2 | | | | 2 | | | | |
| Pungent | | | | | | | | | | |
| Oily | | | 1 | | | | 1 | 1 | | |
| Tallowy | | | | | | | | | | |
| Frying oil | 2 | | | | | | | | | |
| Stale Nut | | | | | | | | | | |
| Fish | | | | | | | | | | |

Pentyl-phenyl ketone has a fruity green smell by itself and the control C and W monitors of this photo-bleach on its own were used for comparison in Table 5. The control C had an intensity of 1 fruity and 1 green. The control W on the other lost the fruity green and a pungent note of intensity 1 emerged. This fruity green note of the photo-bleach itself was perceivable on line dried treated monitors for grape seed, hemp, sunflower and rapeseed, cocoa soft, pumpkin, almond and jojoba (as indicated by an intensity of 1).

To determine the volatile aromas of the constituent fatty acids themselves 20% emulsions of oleic, linoleic and linolenic acids where prepared as described for oils above and cotton sheetings padded to the levels seen in Table 2 with and without Acid Red 51 photo-bleach at a 0.0606 mg/g fabric level. The panel assessment of the odours is summarised in Table 7.

It is clear that linolenic acid with three double bonds results in a fishy off-odour which can and be detrimental to the overall perfume impact of the composition.

TABLE 7

Aromas generated (after one day at 20 C.) on cotton sheeting treated by fatty acid emulsions.

| Fatty | Without Acid Red 51 | | With Acid Red 51 | |
|---|---|---|---|---|
| acid* | C | W | C | W |
| Control (non-ionic and water) | Laundry died inside with stale slightly | Clean laundry Slightly oily | Laundry died inside with stale slightly | Clean laundry |

TABLE 7-continued

Aromas generated (after one day at 20 C.) on cotton sheeting treated by fatty acid emulsions.

| Fatty | Without Acid Red 51 | | With Acid Red 51 | |
|---|---|---|---|---|
| acid* | C | W | C | W |
| | fishy smell | | fishy smell | |
| Oleic | Clean laundry Green cucumber | Clean laundry Green cucumber and volatile Ozonic | Clean fresh pleasant laundry dried outside | Clean fresh Sweet perfume smell of caramel/honey |
| Linoleic | Clean laundry Green cucumber | Clean Green slightly oily | Clean Green cucumber | Clean fresh sweet caramel/honey smell Ozonic pungent volatiles |
| Linolenic | Strong fishy | Less fishy Pungent Oily | Strong fishy Slight green | Less fishy Some Green Pungent Slightly sweet caramel |

*Oleic acid was a 90% assay from Aldrich, linoleic was a 60% assay from Sigma and linolenic was a 70% assay with 25% linoleic and 5% oleic from Fluka.

Example 2

Photo-Bleach Interaction with Perfumes

In this set of Examples the emulsion of a perfume accord, as listed below, was padded onto cotton sheeting as described above and the aromas evaluated. The cloths were line dried inside and treated in the weather-o-meter as described before and then stored in small bottles for panel to sniff. The bottles were stored under fluorescent light in capped bottles.

A model perfume "K" containing the base note ingredients listed below was used in the study of photo-bleach interaction.

| ingredient | wt % | ClogP | Mol Weigh |
|---|---|---|---|
| Bangalol | 20 | 3.728 | 208.34 |
| Iso E super | 20 | 4.138 | 234.38 |
| hexyl cinnamic aldehydes | 20 | 4.677 | 216.32 |
| Cyclopentadecanolide | 20 | 5.294 | 240.38 |
| phenyl ethyl 2 phenylacetate 2 | 20 | 3.624 | 240.30 |

TABLE 8

Amount of padded "K" perfume on cotton sheeting fabrics in presence of two levels of AR 51 photo-bleach.

| Sample | Acid Red 51/mg | Dry weight/g | Wet weight/g | Pick up/g | mg perfume/g fabric |
|---|---|---|---|---|---|
| C | 0 | 14.66 | 33.26 | 18.60 | 0 |
| $C_{AR1}$ | 0.01 | 14.60 | 33.43 | 18.83 | 0 |
| $C_{AR2}$ | 0.02 | 14.60 | 33.82 | 19.22 | 0 |

TABLE 8-continued

Amount of padded "K" perfume on cotton sheeting fabrics in presence of two levels of AR 51 photo-bleach.

| Sample | Acid Red 51/mg | Dry weight/g | Wet weight/g | Pick up/g | mg perfume/g fabric |
|---|---|---|---|---|---|
| K | 0 | 14.37 | 32.69 | 18.32 | 0.18 |
| $K_{AR1}$ | 0.01 | 14.56 | 33.32 | 18.76 | 0.18 |
| $K_{AR2}$ | 0.02 | 14.23 | 32.88 | 18.65 | 0.19 |

C is the control cotton without photo-bleach which is treated only with water and the same level of non-ionic surfactant as present in samples containing perfume "K".

TABLE 9

Odour description and intensity (in brackets) of control (C) and perfumed cotton in presence and absence of Acid Red 51.

| | Day 1 | | Day 3 | | Day 15 | |
|---|---|---|---|---|---|---|
| Sample | C | W | C | W | C | W |
| C | Slightly musty (0) | Fresh (0) | Slightly musty (0) | Fresh (0) | Neutral (0) | Fresh (0) |
| $C_{AR1}$ | Neutral (0) | Fresher (0) | Fresh (0) | Fresher + ozonic (0) | Fresher ozonic (0) | Fresher ozonic (0) |
| $C_{AR2}$ | Neutral (0) | Fresher (0) | Fresh (0) | Fresher + ozonic (0) | Fresher ozonic (0 | Fresher ozonic (0 |
| K | (2.5) | (3.0) | (3.0) | (3.0) | (2.5) | (2.5) |
| $K_{AR1}$ | (3.0) | (2.5) | (2.0) | Lighter notes (2.0) | Lighter notes (2.5) | Change of notes (1.5) |
| $K_{AR2}$ | (2.5) | Like original + ozonic (3.0) | (2.0) | Lighter notes (2.0) | Change of notes (2.0) | Change of notes (2.0) |

A noticeable effect of the photo-bleach was that it changed the smell of cotton. Cotton control line dried inside had a slightly musty off odour. This disappears when dried in weather-o-meter and freshness emerges. With photo-bleach the musty off odour is not present and cloths smell neutral whereas with the presence both of photo-bleach and weather-o-meter treatment a stronger freshness and clean smell develops. With time a pungent ozonic smell develops (not unpleasant) which adds to the sense of cleanliness.

In the presence of perfume photo-bleach initially does not alter the perfume notes unless large level present and the cloths are exposed to sunlight but with time the original perfume note begins to change and lighter fresher notes develop. The intensity of the original perfume becomes less with time.

Example 3

Photo-Bleach Interaction in Fabric Conditioners

The fabric conditioner liquids in Table 10 below were prepared in a desk-top batch mixer with a 3-pitch blade impeller. To the batch water at 60° C. a co-melt of the pro-fragrance oil and half of the non-ionic surfactant was added under agitation at 500 RMP. Then a co-melting the cationic softener, fatty alcohol, and the other half of the non-ionic surfactant at about 70° C. was added to the batch while agitating. After 15 minutes of mixing the batch was cooled to 30° C. by cold water recirculation and perfume was added.

TABLE 10

Fabric conditioner examples containing pro-fragrance lipids.

| | 1 | 2 | 3 | 4 | 5 | 6 | 7 | 8 |
|---|---|---|---|---|---|---|---|---|
| Ingredients | | | | | | | | |
| Stepantex ™ UL 85 | 4.95 | 4.95 | 4.95 | 4.95 | 4.95 | 4.95 | 4.95 | 4.95 |
| Stenol ™ 16/18 L | 0.45 | 0.45 | 0.45 | 0.45 | 0.45 | 0.45 | 0.45 | 0.45 |
| Genapol ™ C200 | 0.1 | 0.1 | 0.1 | 0.1 | 0.1 | 0.1 | 0.1 | 0.1 |
| Softline ™ X5 | 0.18 | 0.18 | 0.18 | 0.18 | 0.18 | 0.16 | 0.18 | 0.19 |
| demin water | to 100 | to 100 | to 100 | to 100 | to 100 | to 100 | to 100 | to 100 |
| Pro-fragrance | | | | | | | | |
| Hexadecane (Sigma) | 0 | 1.0 | 0 | 0 | 0 | 0 | 0 | 0 |
| Squalene (Sigma) | | | 1.0 | 0 | 0 | 0 | 0 | 0 |
| Hemp oil | | | | 0.5 | 0 | 0 | 0 | 0 |
| Palm and Canola | | | | | 0.5 | 0 | 0 | 0 |
| Soy bean oil | | | | | | 0.5 | 0 | 0 |
| Castor oil | | | | | | | 0.5 | 0 |
| E-oil (Vitamin E) | | | | | | | | 0.5 |

Stepantex UL 85 is a hard tallow EA quat (ex Stepan) with 20% mono-, 50% di- and 30% tri-ester. It contains 85% active and 15% IPA. Stenol 16/18 L (ex Cognis) is a fatty alcohol (complexing agent) with a mixture of C16 and C18 saturated chains. Genapol C200 (ex Clariant) is a coco based ethoxylated non-ionic surfactant with 20EO, Softline X5 (ex Givaudan) is a perfume accord with poor longevity and used here at ½ standard level used in dilute fabric conditioners.

Some of the Examples in Table 10 then were applied to terry toweling monitors for perfume assessment by an expert panel. Three 20×20 cm terry monitors were treated in a Tergotometer™ by first washing them in 1 liter of tap water followed by spin drying. These monitors were then rinsed in the Tergotometers for 5 minutes in a liter of tap water to which 2 g of the fabric conditioner was added followed by 0.01 mg of photo-bleach Acid Red 51.

The terry monitors were then spin dried and one set exposed to the Weather-o-meter for 30 minutes (W) and another set dried control (C) as described earlier, after 24 hours (day 1) they were presented to the panel. The panel assessment is summarised in Table 11. For the perfume longevity beyond day 1 the monitors were left exposed to florescent light or natural light during the day and wrapped in foils during the night.

TABLE 11

Average perfume intensity of fabric conditioners with and without photobleach Acid Red 51 (AR51) at 6.5 × $10^{-5}$ mg/g of fabric.

| Monitors age | Condition | Ex 1 | Ex 1 + AR51 | Ex 2 ± AR51 | Ex 3 + AR51 | Ex 3 + 2 × AR51 |
|---|---|---|---|---|---|---|
| Day 1 | C | 1.0 | 1.5 | 1.5 | 1.5 | 1.5 |
| | W | 1.0 | 2.0 | 1.5 | 2.0 | 2.5 |
| Day 2 | C | 1.0 | 1.0 | 1.5 | 1.5 | 1.5 |
| | W | 1.0 | 1.5 | 1.0 | 1.5 | 2.5 |
| Day 5 | C | 0.5 | 1.5 | 2.0 | 1.5 | 2.5 |
| | W | 0.5 | 1.5 | 1.5 | 1.5 | 2.0 |
| Day 6* | C | 0 | 1.5 | 1.5 | 2.0 | 1.5 |
| | W | 0 | 1.5 | 1.5 | 2.0 | 2.5 |
| Day 15 | C | 0 | 0.5 | 0 | 0.5 | 1.0 |
| | W | 0 | 0 | 0 | 1.0 | 1.0 |

*On day 5 monitors exposed to natural sunlight seemed to have increased their perfume intensity the following day.

Comparison with Example 1 (control) shows that the presence of photo-bleach enhances the perfume perception by the panel at half the normal level of perfume used in such compositions.

Example 2 with hexadecane (saturated oil) is included as a control for the squalene examples. Hexadecane is not expected to react with the photo-bleach. Therefore its effect compares well with perfume with photo-bleach without oil. Squalene enhances the perfume effect through its interaction with photo-bleach. Increased level of photo-bleach boosts the perfume longevity.

Example 4

Photo-Bleach Interaction in Fabric Conditioners

The following examples where processed as described before with 10% of the batch water withhold to make a solution of the photo-bleach which was post dosed into the formulation after addition of perfume.

TABLE 12

Fabric conditioner examples containing Photo-bleach and pro-fragrance.

| | 9 | 10 | 11 | 12 |
|---|---|---|---|---|
| Ingredients | | | | |
| Stepantex ™ UL 85 | 4.95 | 4.95 | 4.95 | 13.5 |
| Stenol ™ 16/18 L | 0.45 | 0.45 | 0.45 | 0.9 |
| Genapol ™ C200 | 0.1 | 0.1 | 0.1 | 0.25 |
| Softline ™ X5 | 0.18 | 0.18 | 0.18 | 0.6 |
| Tinolux BBS* | 0.002 | 0 | 0 | 0 |
| Tinolux BMC* | 0 | 0.002 | 0 | 0 |
| Tinolux BBS + AR51** | 0 | 0 | 0.0027 | 0 |
| Tinolux BMC | 0 | 0 | 0 | 0.004 |
| demin water | to 100 | to 100 | to 100 | to 100 |
| Pro-fragrance | | | | |
| Squalene (Sigma) | 0.5 | 0.5 | 0 | 1.0 |
| Rapeseed oil | 0 | 0 | 0.50 | 0 |

*Tinolux BBS and Tinulox BMC metal phthalocyanine (ex Ciba).
**Tinolux BBS at 0.0015 + AR51 at 0.0009% levels.

The level of photo-bleach used in the compositions of Table 12 did not induce any colloidal or chemical instability on storage at ambient temperatures (compositions had a blue colour and stored in shrink-sleeved product bottles.

The invention claimed is:

1. A composition comprising:

a non-detergent fabric conditioner comprising:

a) a singlet oxygen photo-bleach present at a level of 0.00001 to 0.05 wt %;

b) from 4 to 30 wt % of a quaternary ammonium fabric conditioner;

wherein the quaternary ammonium fabric conditioner excludes 1,2 bis [hardened tallowoyloxy]-3-trimethylammoniumpropane chloride; and, c) at least one pro-fragrance which comprises at least one C═C, non-aromatic, double-bond;

wherein the pro-fragrance is a precursor of a volatile odoriferous compound;

wherein, when the pro-fragrance is combined with the photo-bleach, the pro-fragrance is converted into at least one volatile odoriferous compound;

wherein the pro-fragrance is not a perfume;

and wherein the non-detergent fabric conditioner is effectively free of anionic surfactants.

2. A composition according to claim 1, wherein the pro-fragrance comprises at least two C═C, non-aromatic, double-bonds.

3. A composition according to claim 2, wherein the pro-fragrance comprises a lipid.

4. A composition according to claim 1, wherein the photo-bleach comprises a water-soluble phthalocyanine compound and/or a xanthene.

5. A composition according to claim 1 wherein the pro-fragrance comprises at least one of, olive oil, palm oil, canola oil, squalene, sunflower seed oil, wheat germ oil, almond oil, coconut oil, grape seed oil, rapeseed oil, castor oil, corn oil, cottonseed oil, safflower oil, groundnut oil, poppy seed oil, palm kernel oil, rice bran oil, sesame oil, soybean oil, pumpkin seed oil, jojoba oil and mustard seed oil.

6. A composition according to claim 1 wherein the pro-fragrance comprises 10 wt % or less of moieties containing three C═C, non-aromatic, double bonds.

7. A composition according to claim 1 wherein the pro-fragrance comprises less than 15 wt % saturated fatty acid residues.

8. A composition according to claim 1 wherein the pro-fragrance comprises less than 15 wt % of fatty acid residues with less than 14 carbon atoms.

9. A composition according to claim 1, comprising a blue or violet shading dye.

10. A composition according to claim 1 comprising 0.01-10% wt of the pro-fragrance.

11. A composition according to claim 1 which is free of fluorescer.

12. A composition according to claim 1 in which the quaternary ammonium fabric conditioner has a monoester level of 10-30% wt.

13. A composition according to claim 1, wherein the pro-fragrance is selected from the group consisting of squalene, hemp oil, palm oil, canola oil, castor oil, vitamin E oil, and combinations thereof.

* * * * *